US006332489B1

(12) United States Patent
Kusano

(10) Patent No.: US 6,332,489 B1
(45) Date of Patent: Dec. 25, 2001

(54) APPARATUS FOR STICKING SHEET MATERIAL

(75) Inventor: Tosizo Kusano, Kyoto (JP)

(73) Assignee: Kyoritsu Industrial Co., Ltd., Kyoto-Fu (JP)

( * ) Notice: Subject to any disclaimer, the term of this patent is extended or adjusted under 35 U.S.C. 154(b) by 0 days.

(21) Appl. No.: 09/544,334

(22) Filed: Apr. 6, 2000

(30) Foreign Application Priority Data

Apr. 12, 1999 (JP) ..... 11-104250

(51) Int. Cl.[7] ..... B65H 5/00; H01J 29/86

(52) U.S. Cl. ..... 156/542; 156/572; 271/197

(58) Field of Search ..... 156/230, 238, 156/381, 382, 540, 542, 571, 572; 271/94, 95, 103, 196, 197; 118/239; 193/35 R

(56) References Cited

U.S. PATENT DOCUMENTS 5,427,368 * 6/1995 Abe et al. .
5,548,388 * 8/1996 Schieck .
5,730,440 * 3/1998 Motooka .

* cited by examiner

*Primary Examiner*—Steven D. Maki
*Assistant Examiner*—John T. Haran
(74) *Attorney, Agent, or Firm*—McDermott, Will & Emery

(57) ABSTRACT

The present invention provides an apparatus for sticking a sheet material on a screen of a picture tube without scratching the surface of the sheet material. In this apparatus for sticking a sheet material on the screen of a picture tube with an adhesive, the picture tube is conveyed while a sheet material (2), to which an adhesive is applied on one face, being pressed on the screen of the picture tube by a pressure roller (80), and the sheet material is gradually transferred from a sheet material transferring member (12) to the screen of the picture tube. The sheet material transferring member (12) comprises a box member (32) in which one face is opened and a sucking mouth is formed, and a sucking belt (38) which is arranged to block the whole open face of the box member, provided with a large number of through holes for sucking the sheet material, and is supported in such a manner as to be movable along a conveying direction of the picture tube in the box member.

5 Claims, 5 Drawing Sheets

Fig. 6 *(PRIOR ART)*
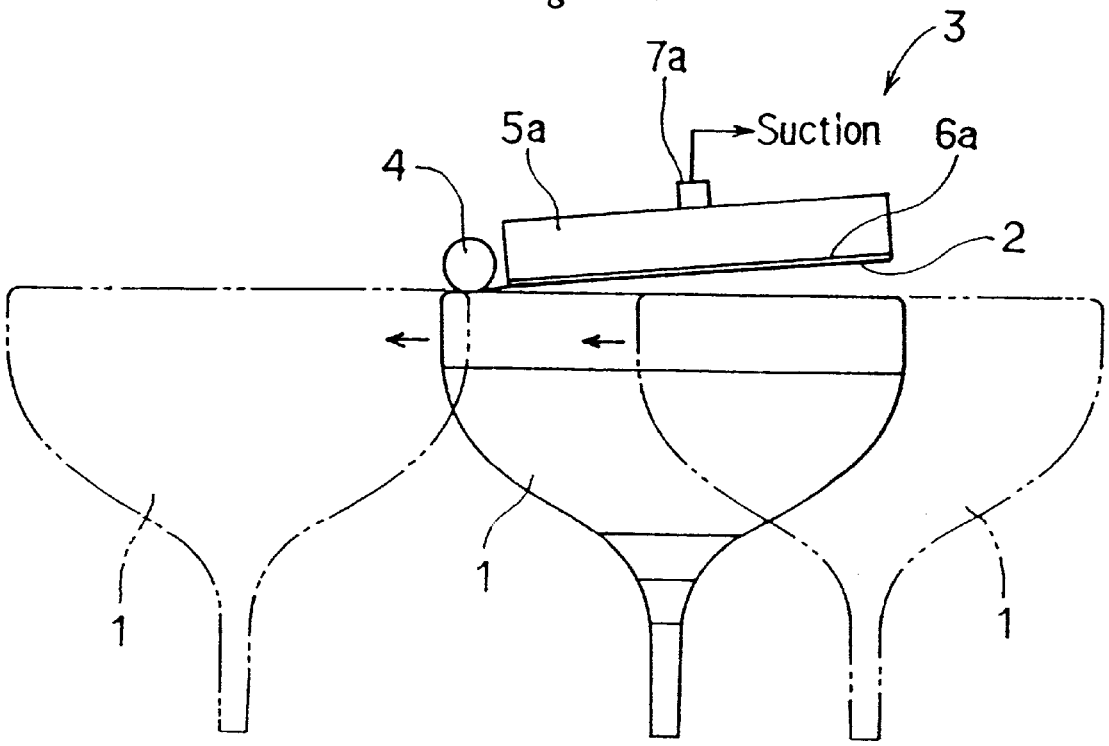
Fig. 7 *(PRIOR ART)*
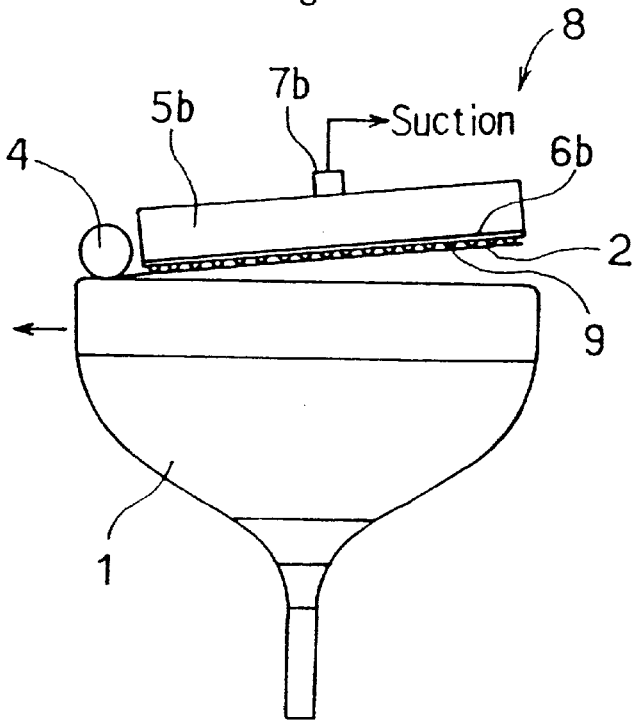

APPARATUS FOR STICKING SHEET MATERIAL

BACKGROUND OF THE INVENTION

1. Field of the Invention

The present invention relates to an apparatus for sticking a sheet material for use in sticking a sheet material with an adhesive on one side thereof to a work such as picture tube for television having a flat screen.

2. Prior Art

In manufacturing process of a picture tube for television, at the last stage thereof, a coating film is formed on the surface of the picture tube screen in order to increase picture quality and prevent diffused reflection. This coating film is formed by the steps of supporting the picture tube with its screen upward, turning it on a vertical axis, and spreading a coating film liquid supplied on the center of the screen uniformly toward the periphery of the screen with centrifugal force. It is, however, a recent trend that picture tubes for television have flat screens, which makes it difficult to form a uniform film on the screen by the conventional method for forming a coating film. The difficulty especially increases as the screen size increases.

In order to cope with the increasing trend toward the flat screen of picture tubes, instead of forming a coating film on the screen surface, a method in which a sheet material which functions like a coating film is stuck onto the screen surface has been recently employed. And for carrying out this method, an apparatus for sticking a sheet material has been developed. As shown in FIG. 6, this known apparatus for sticking a sheet material comprises: a picture tube supporting and conveying mechanism (not shown) for supporting a picture tube 1 with its screen upward and conveying the picture tube 1 in horizontal direction; a sheet material transferring member 3 for holding a sheet material 2 and transferring the sheet material 2 to the screen of the picture tube 1; and a pressure roller 4 for pressing a part of the sheet material 2 on the screen of the picture tube 1.

The sheet material transferring member 3 consists of a flat box member 5*a* of which plan view is a rectangular shape of a size substantially equal to that of the sheet material 2. One face of the box member 5*a* is of a porous sucking plate 6*a* having a large number of through holes. The box member 5*a* is provided with a sucking mouth 7*a*, and the sucking mouth 7*a* is connected to an intake blower (not shown) so that the air inside of the box member 5*a* may be sucked up. An adhesive is applied on one face of the sheet material 2. A sucking force acts on the sheet material 2 through the large number of through holes of the porous sucking plate 6*a*, whereby the porous sucking plate 6*a* of the sheet material transferring member 3 sucks the other face of the sheet material 2 where an adhesive is not applied. The sheet material 2 is held by the sheet material transferring member 3 with a part of the sheet material 2 slightly protruding from the porous sucking plate 6*a*. The sheet material transferring member 3 is supported by a transferring member supporting and moving mechanism not shown in the drawing, and reciprocates between a sheet material sticking position shown in FIG. 6 where the sheet material 2 sucked and held on the porous sucking plate 6*a* faces the screen of the picture tube 1 and a sheet material delivery position not shown in the drawing where sheet materials 2 are delivered one by one to the porous sucking plate 6*a*. The sheet material transferring member 3 is supported so that its forward side in the conveying direction of the picture tube 1 may be slightly inclined downward (descend) at the sheet material sticking position.

The pressure roller 4 is located on the forward side from the sheet material transferring member 3 in the conveying direction of the picture tube 1 at the sheet material sticking position so that the pressure roller 4 may come near the sheet material transferring member 3 and cross the conveying direction of the picture tube 1 at a right angle. The pressure roller 4 is rotatably supported and driven to move slightly in vertical direction. When the sheet material 2 is stuck on the screen of the picture tube 1, the pressure roller 4 moves downward and presses a part of the sheet material 2 on the screen of the picture tube 1.

In the foregoing known apparatus for sticking a sheet material, the sheet material is stuck to the picture tube as described below.

First, at the sheet material delivery position, sheet materials are supplied one by one from a sheet material supplying mechanism not shown to the sheet material transferring member 3, and one sheet material 2 is sucked and held on the porous sucking plate 6*a* of the sheet material transferring member 3. Then, the sheet material transferring member 3 moves to the sheet material sticking position, and the picture tube 1 is delivered to the sheet material sticking position. Then, with the sheet material 2, which is sucked and held on the porous sucking plate 6*a* of the sheet material transferring member 3, facing the screen of the picture tube 1, the pressure roller 4 moves downward to press a front edge portion of the sheet material 2 protruding from the porous sucking plate 6*a* on the screen of the picture tube 1, whereby the portion is stuck on the screen of the picture tube 1 with an adhesive. With the pressure roller 4 pressing a part of the sheet material 2 on the screen of the picture tube 1, the picture tube 1 is moved forward, whereby a friction force is generated and the generated friction force rotates the pressure roller 4. Thus, the sheet material 2 is gradually stripped from the porous sucking plate 6*a* of the sheet material transferring member 3 and is gradually stuck on the screen of the picture tube 1. Finally, the whole sheet material 2 is stripped from the porous sucking plate 6*a* of the sheet material transferring member 3, and the whole sheet material 2 is stuck on the whole screen of the picture tube 1.

After the sheet material 2 is completely stuck to the picture tube 1, the sheet material transferring member 3 moves to the sheet material delivery position and receives a sheet material from the sheet material supplying mechanism. The foregoing operation is repeated, and the sheet material 2 is stuck on a next coming picture tube 1.

FIG. 7 illustrates an example of another construction of a sheet material transferring member in a conventional apparatus for sticking a sheet material. In the same manner as the foregoing sheet material transferring member, this sheet material transferring member 8 comprises a flat box member 5*b* which is shaped into a rectangle in a plan view with one face consisting of a porous sucking plate 6*b* having a large number through holes. The box member 5*b* is provided with a sucking mouth 7*b* connected to an intake blower. In this sheet material transferring member 8, a number of small rollers 9 are rotatably mounted on the whole face of the porous sucking plate 6*b*. In this sheet material transferring member 8, the sheet material 2 is sucked and held on the porous sucking plate 6*b* with the sheet material 2 in contact with the number of small rollers 9. The sheet material 2 is stripped from the porous sucking plate 6*b* with the number of small rollers 9 making a rolling contact with the sheet material 2 when the sheet material 2 is stuck on the screen of the picture tube 1.

In the apparatus for sticking a sheet material constructed as shown in FIG. 6, when the sheet material 2 is stuck on the screen of the picture tube 1, the sheet material 2 is stripped from the porous sucking plate 6*a* of the sheet material transferring member 3 while being in rolling contact with the porous sucking plate 6*a*. There is a possibility that this causes linear scratches on the surface of the sheet material 2. The scratches on the surface of the sheet material 2 stuck on the screen of the picture tube 1 give a negative influence on the performance of the picture tube 1. Even when the porous sucking plate 6*a* is made of a material of extremely small in coefficient of friction in order to prevent such scratches, it is impossible to completely prevent occurrence of the scratches. In addition, when foreign matter such as dust is on the surface of the porous sucking plate 6*a*, it is probable that more scratches are formed on the surface of the sheet material 2.

In the sheet material transferring member 8 shown in FIG. 7, when the sheet material 2 is stuck on the screen of the picture tube 1, the sheet material 2 makes a rolling contact with the number of small rollers 9. Therefore, it is certain that less scratches are formed on the surface of the sheet material 2 as compared with the sheet material transferring member 3 shown in FIG. 6. But, it is impossible to completely prevent scratches on the sheet material 2 even in this sheet material transferring member 8. When foreign matter such as dust sticks onto the small rollers 9 to the extent that some of rollers 9 do not rotate smoothly, linear scratches come to be formed on the surface of the sheet material 2 in the same manner as those in the sheet material transferring member 3 shown in FIG. 6.

SUMMARY OF THE INVENTION

The present invention was made to solve the above-discussed problems and has an object of providing an apparatus for sticking a sheet material capable of preventing occurrence of any scratch on the surface of a sheet material when the sheet material is stuck on a work such as picture tube for television.

To accomplish the foregoing object, an invention according to claim 1 provides an apparatus for sticking a sheet material comprising:

work supporting and conveying means for supporting and conveying a work in one direction;

a sheet material transferring member shaped into a box and having a sheet material holding face for sucking and holding a sheet material to be stuck on a stuck face of the work;

suction means for sucking air inside of the box member of the sheet material transferring member so that the sheet material is stuck onto said sheet material holding face;

transferring member supporting and moving means for supporting and moving a transferring member, which supports said sheet material transferring member and reciprocates the sheet material transferring member between a sheet material sticking position, where the stuck face of the work conveyed by said supporting and conveying means faces the sheet material sucked and held on said sheet material holding face, and a sheet material delivery position where sheet materials are delivered one by one to the sheet material holding face;

sheet material supply means for supplying sheet material, which delivers sheet materials one by one to the sheet material holding face of said sheet material transferring member at said sheet material delivery position; and a pressure roller which is located on a forward side from said sheet material transferring member in the conveying direction of the work at said sheet material sticking position in such a manner as to come near the sheet material transferring member and cross the conveying direction of the work at a right angle, and turns on an axis while pressing a part of the sheet material on the stuck face of the work;

in which the work is conveyed by said work supporting and conveying means with said pressure roller pressing the sheet material, to one face of which an adhesive is applied, on the stuck face of the work, whereby the sheet material is gradually transferred from the sheet material holding face of said sheet material transferring member to the stuck face of the work, and the sheet material is stuck on the stuck face of the work with the adhesive;

wherein the improvement comprises: a box member in which one face is opened and a sucking mouth connected to said suction means is formed; and a sucking belt which is arranged to block the whole open face of said box member, has a plurality of through holes for sucking the sheet material, and is supported in such a manner as to move along the conveying direction of the work in said box member.

An invention according to claim 2 provides the apparatus for sticking a sheet material according to claim 1, wherein the sucking belt is an endless belt, and the endless belt is put on and moved round a plurality of rollers which are arranged to cross the conveying direction of the work at a right angle in said box member and are rotatably supported.

An invention according to claim 3 provides the apparatus for sticking a sheet material according to claim 1 or 2, wherein the plurality of through holes of said sucking belt are formed only in a region of a length corresponding to the open face of said box member so that the region serves as a sheet material sucking face.

An invention according to claim 4 provides the apparatus for sticking a sheet material according to any of claims 1 to 3, wherein the apparatus is provided with belt drive means for driving a belt which moves said sucking belt synchronously with a moving speed of the work conveyed by said work supporting and conveying means.

An invention according to claim 5 provides the apparatus for sticking a sheet material according to any of claims 1 to 4, wherein the work is a picture tube for television, and the sheet material is stuck on a flat screen of the picture tube.

In the apparatus for sticking a sheet material of the invention according to claim 1, sheet materials are delivered one by one from the sheet material supply means to the sheet material transferring member at the sheet material delivery position. In the sheet material transferring member, the air inside of the box member is sucked by the suction means through the sucking mouth of the box member, whereby sucking force acts on the sheet material through the through holes of the sucking belt blocking the open face of the box member, and the sheet material is sucked and held on the surface of the sucking belt serving as the sheet material holding face. The sheet material transferring member holding the sheet material is moved from the sheet material delivery position to the sheet material sticking position by the transferring member supporting and moving means. On the other hand, the work supporting and conveying means conveys the work to the sheet material sticking position. Thus, the stuck face of the work faces the sheet material sucked and held on the sheet material holding face of the sheet material transferring member at the sheet material sticking position. Then, a front edge portion of the sheet material is pressed on a front edge portion of the stuck face of the work by the pressure roller which is located near the sheet material transferring member and on a forward side from the sheet material transferring member in the conveying direction of the work, and the front edge portion of the sheet material is stuck on the stuck face of the work with the adhesive. In this condition, the work is moved by the work supporting and conveying means, whereby the sheet material is pulled by an adhered portion between the sheet material and the stuck face of the work. The pressure roller rotates due to a friction force generated between the surface of the sheet material and the pressure roller, and the sheet material is gradually stripped from the sucking belt of the sheet material transferring member. Thus, the sheet material is gradually stuck on the stuck face of the work. At this time, the sucking belt moves together with the sheet material along the conveying direction of the work in the box member as the sheet material moves. The sheet material does not make any rolling contact with the sucking belt serving as the sheet material holding face of the sheet material transferring member, and therefore there is no possibility that the sucking belt scratches the surface of the sheet material. Then, the whole sheet material is stripped from the sucking belt of the sheet material transferring member, and the whole sheet material is stuck on the stuck face of the work. After the sheet material is completely stuck on the stuck face of the work, the sheet material transferring member is moved to the sheet material delivery position by the means for supporting and moving a transferring member. A sheet material is supplied from the sheet material supply means, and the foregoing operation is repeated. When using the apparatus for sticking a sheet material of the invention according to claim 1, the sheet material is stuck on the work without forming scratches on the surface of the sheet material.

In the sticking apparatus of the invention according to claim 2, when the sheet material is stuck on the stuck face of the work, the sucking belt moves round in the box member as the sheet material held by the sheet material transferring member is pulled by the moving work and is pulled out from the sheet material transferring member. As a result, any slipping between the sheet material and the sucking belt does not occur, and it is possible to accurately prevent scratches on the sheet material.

In the sticking apparatus of the invention according to claim 3, when the sheet material is stuck on the stuck face of the work, the sheet material is gradually pulled out from the sheet material transferring member and is gradually stripped from the sheet material sucking face of the sucking belt provided with the plurality of through holes. And when and the sucking belt moves in the box member, any through hole is not formed in a region of the sucking belt where the sheet material is not sucked, in a portion of the sucking belt exposed in the open face of the box member. Accordingly, the open face of the box member is blocked by a part of the sheet material and the portion not provided with through holes of the sucking belt. Therefore, even when the sucking belt moves as the sheet material is pulled out from the sheet material transferring member, the sucking force acting on the sheet material is not reduced. As a result, the sheet material is securely held by the sheet material transferring member until the whole sheet material is stripped from the sucking belt. Consequently, the sheet material is preferably stuck on the work.

In the sticking apparatus of the invention according to claim 4, the sucking belt is moved by the belt drive means synchronously with the moving speed of the work. This makes it possible to accurately prevent slipping between the sheet material and the sucking belt which may cause scratches on the sheet material when the sheet material is stuck on the stuck face of the work. As a result, it is possible to completely prevent scratches on the sheet material.

In the sticking apparatus of the invention according to claim 5, scratches are not formed on the surface of the sheet material when the sheet material is stuck on the flat screen of the picture tube for television. As a result, it is possible to prevent deterioration in the performance of the picture tube caused by the scratches on the sheet material.

Other objects, features and advantages of the invention will become apparent in the course of the following description with reference to the accompanying drawings.

BRIEF DESCRIPTION OF THE DRAWINGS

FIG. 6 is a view showing an example of construction of an essential part of a conventional apparatus for sticking a sheet material to explain operation of sticking a sheet material on a screen of a picture tube using the apparatus.

FIG. 7 is a schematic view showing another example of a construction of an essential part of a conventional apparatus for sticking a sheet material to explaining operation of sticking a sheet material on a screen of a picture tube using the apparatus.

DESCRIPTION OF THE PREFERRED EMBODIMENT

A preferred embodiment of the present invention is hereinafter described with reference to FIG. 1 to FIG. 5

Figure 1:
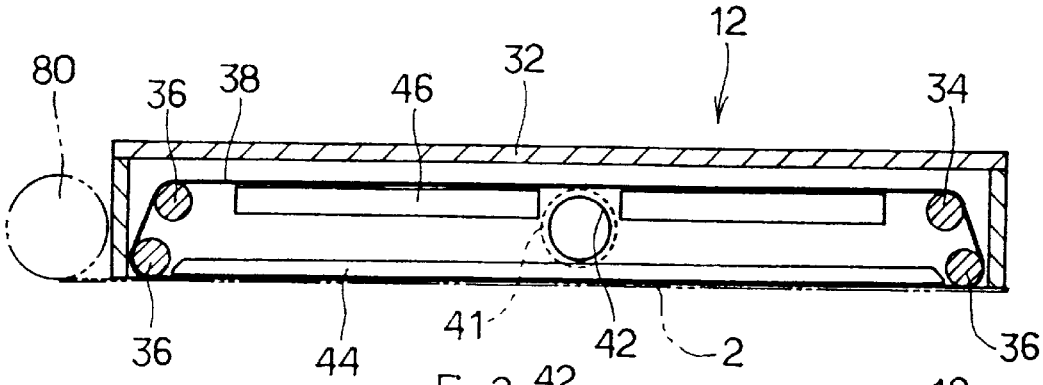
FIG. 1 is a longitudinal sectional view showing an embodiment of the present invention applied to an apparatus for sticking a sheet material on a flat screen of a picture tube for television and showing a sheet material transferring member which is an essential requirement of the apparatus for sticking a sheet material.
Figure 2:
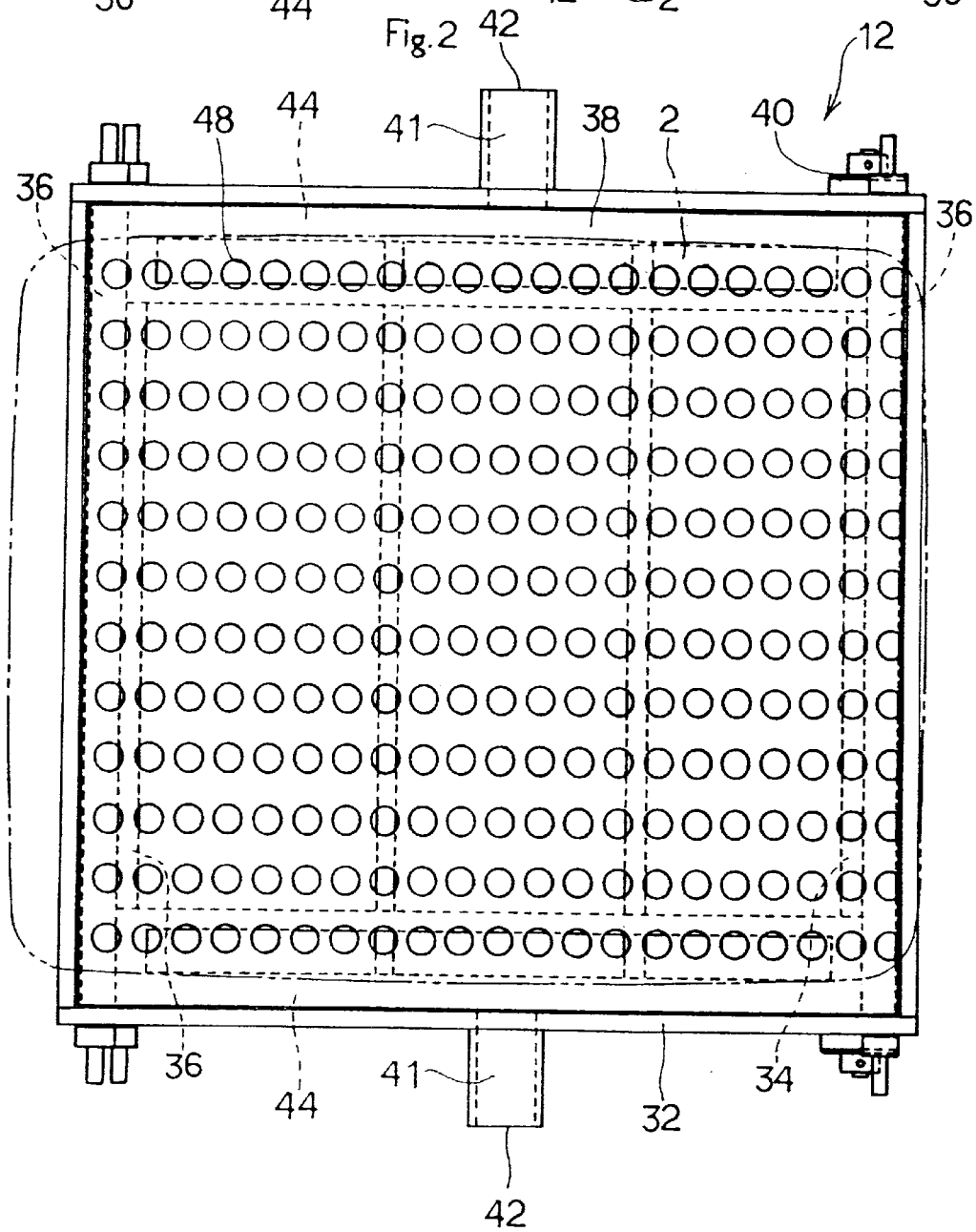
FIG. 2 is a plan view of the sheet material transferring member shown in FIG. 1.
Figure 3:
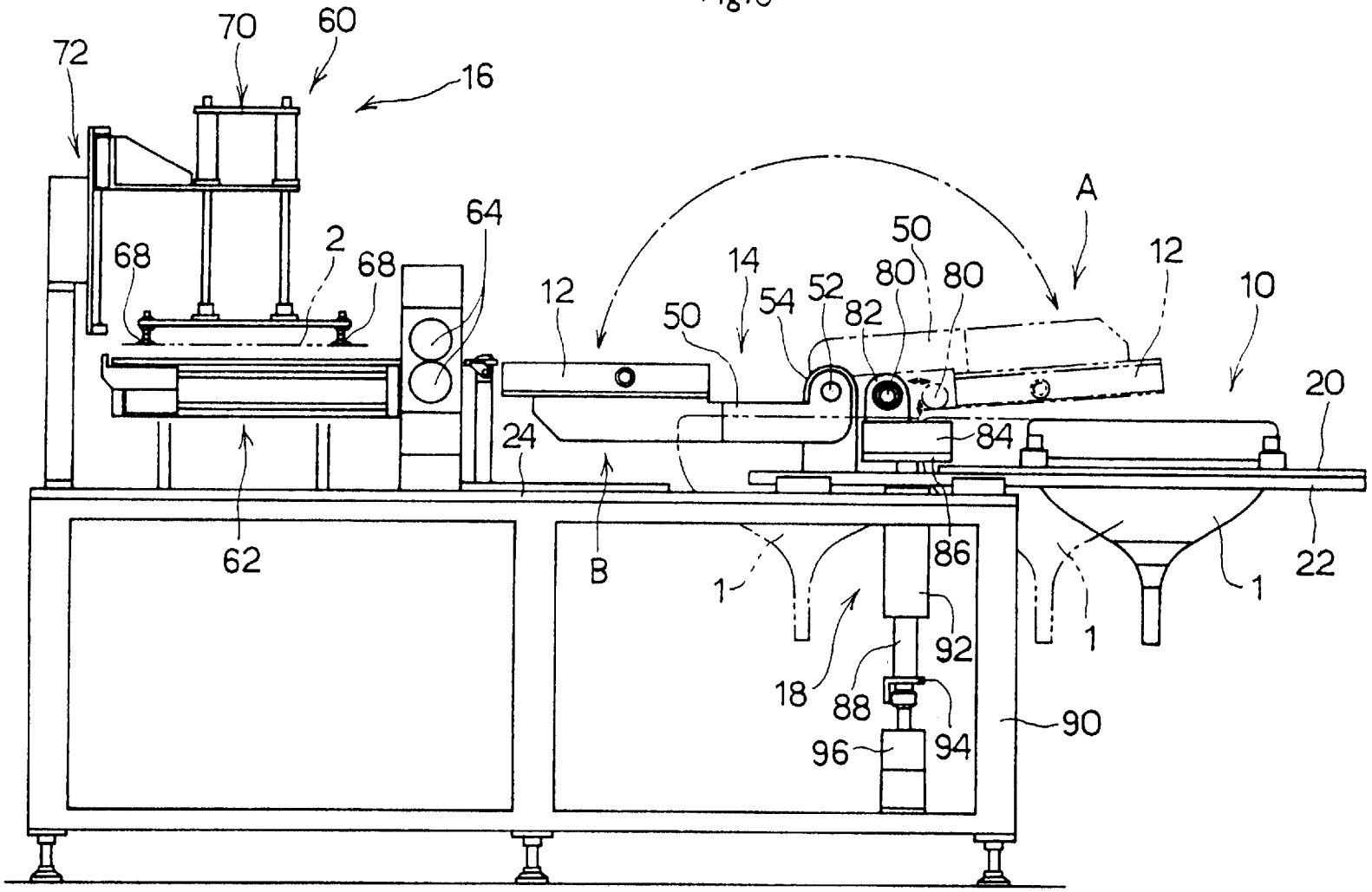
FIG. 3 is a front view showing the whole construction of the apparatus for sticking a sheet material provided with the sheet material transferring member shown in FIG. 1.
Figure 4:
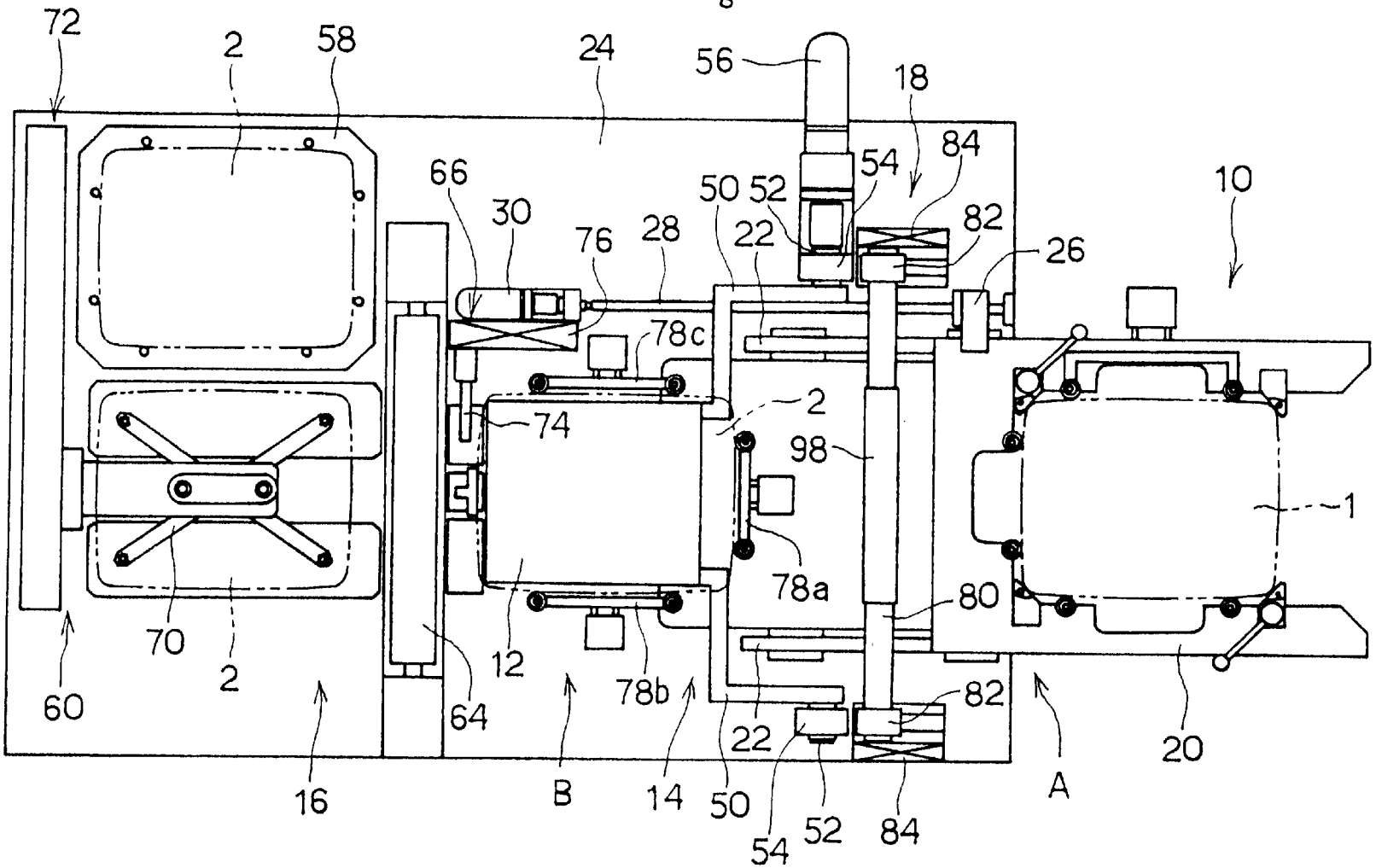
FIG. 4 is a plan view showing the whole construction of the apparatus for sticking a sheet material shown in FIG. 3.
Figure 5:
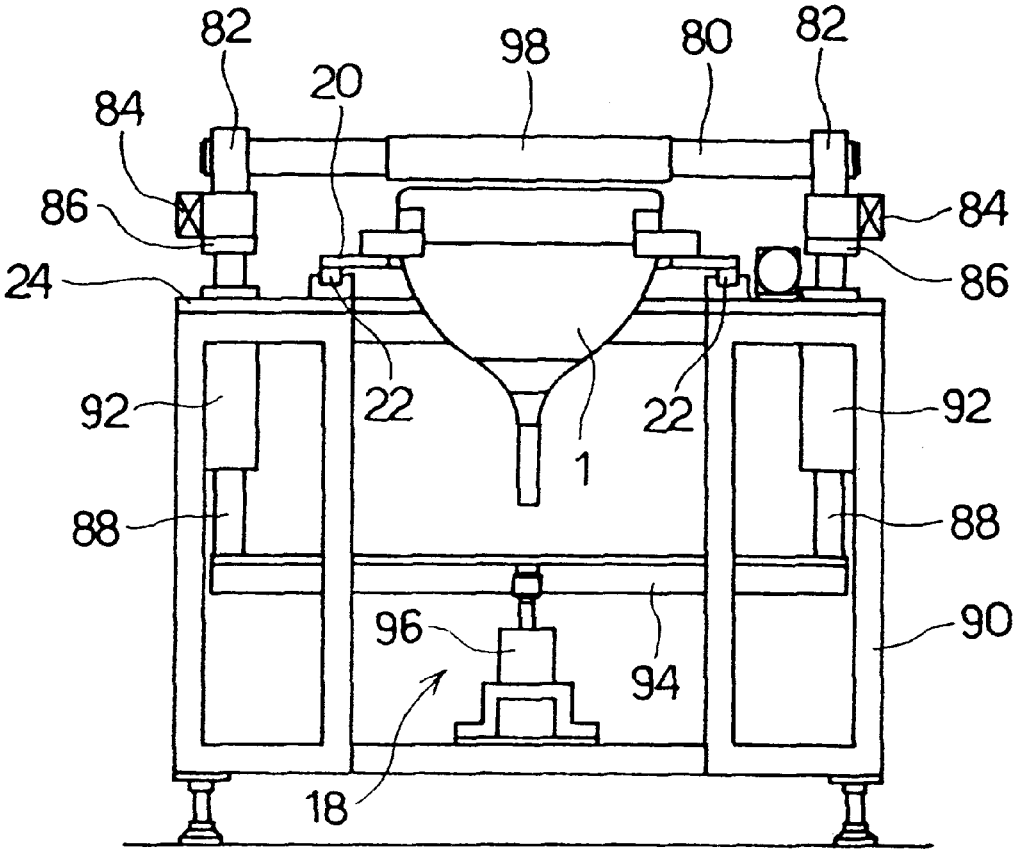
FIG. 5 is a side view showing the whole construction of the apparatus for sticking a sheet material shown in FIG. 3.

FIGS. 1 to 5 show an example of an embodiment according to the present invention applied to an apparatus for sticking a sheet material to a flat screen of a picture tube for television. FIG. 1 is a longitudinal sectional view of a sheet material transferring member which is a component of the apparatus for sticking a sheet material; FIG. 2 is a plan view of the sheet material transferring member; FIG. 3 is a front view showing the whole construction of the apparatus for sticking a sheet material; FIG. 4 is a plan view of the whole construction of the apparatus for sticking a sheet material; and FIG. 5 is a side view thereof.

As shown in FIG. 3 and FIG. 4, this apparatus for sticking a sheet material comprises: a picture tube supporting and conveying mechanism 10 for supporting a picture tube 1 with its screen upward and conveying the picture tube 1 in horizontal direction; a sheet material transferring member 12 for sucking and holding a sheet material 2 to be stuck on the screen of the picture tube 1 and transferring the sheet material 2 to the screen of the picture tube 1; a transferring member supporting and moving mechanism 14 for supporting and reciprocating the sheet material transferring member 12 between a sheet material sticking position A and a sheet material delivery position B; a sheet material supplying mechanism 16 for supplying sheet materials 2 one by one to the sheet material transferring member 12 at the sheet material delivery position B; a sheet material pressing mechanism 18 located at the sheet material sticking position A where the sheet material 2 is stuck on the screen of the picture tube 1 by pressing a part of the sheet material 2 on the screen of the picture tube 1 and sticking the sheet material 2 on the screen of the picture tube 1; and so on.

The picture tube supporting and conveying mechanism 10 comprises a movable stage 20 which is ⊐-shaped in plan view and holds and fixes the picture tube 1 upward, a pair of left and right guide rails 22, 22 which are fixed on the base 24 and are slidably engaged with the movable stage 20 to support the movable stage 20, a nut 26 fixed onto the movable stage 20, a feed screw 28 which is screw-engaged with the nut 26 and is rotatably supported on the base 24, and a drive motor 30 capable of rotating in forward and reverse directions which is connected to the feed screw 28 and turns the feed screw 28. When the drive motor 30 is driven to rotate the feed screw 28 in forward direction, the movable stage 20 holding the picture tube 1, on which screen the sheet material 2 is going to be stuck, is moved forward (to the left in FIG. 3 and FIG. 4). When the feed screw 28 is rotated in the reverse direction, the movable stage 20 holding the picture tube 1, on which screen the sheet material 2 is stuck, is moved backward (to the right in FIG. 3 and FIG. 4).

As shown in FIG. 1 and FIG. 2, the sheet material transferring member 12 comprises: a flat box member 32 which has one open face and is shaped into a rectangle in plan view to be a size as large as the sheet material 2, in other words, a rectangle having a length in width direction (vertical direction in FIG. 2) slightly longer than that of the sheet material 2 and a length in longitudinal direction (horizontal direction in FIG. 2) slightly shorter than that of the sheet material 2; one driving roller 34 and three driven rollers 36 which are stored in the box member 32, placed to be parallel with each other in the width direction of the box member 32, and rotatably supported by the box member 32; a sucking belt 38 put round the driving roller 34 and the three driven rollers 36; and a drive motor 40 for driving and rotating the driving roller 34. The driving roller 34 and the driven rollers 36 are located at a forward end position and a backward end position of the box member 32, and the open face of the box member 32 is substantially blocked by the sucking belt 38 put round the rollers 34, 36. The drive motor 40 is controlled by control means not shown so that the sucking belt 38 may move synchronously with a moving speed of the picture tube 1 conveyed forward by the picture tube supporting and conveying mechanism 10.

The box member 32 is provided with a sucking pipe 41 which is communicated to the inside of the box member 32, and a sucking mouth 42 of the sucking pipe 41 is connected with an intake blower not shown through a pipe. Rotatably supporting plates 44, 46 are fixed inside the box member 32 and support rotatably the sucking belt 38 from the backside. The sucking belt 38 possesses many through holes 48. A large number of through holes 48 are formed only in a region of the sucking belt 38 which region has a length corresponding to the open face of the box member 32, and are distributed uniformly in the whole region. The region with the number of through holes 48 in the sucking belt 38 serves or functions as a sheet material sucking face for sucking and holding the sheet material 2.

The transferring member supporting and moving mechanism 14 comprises: a pair of left and right turning arms 50, 50 each having one end fixed to the sheet material transferring member 12; turning shafts 52, 52 connected to the other end portions of the turning arms 50, 50 respectively; bearings 54, 54 rotatably supporting the rotatable shafts 52, 52 respectively; and a drive motor 56 capable of rotating in forward and reverse directions with a rotary shaft connected to one of the turning shafts 52. The drive motor 56 is operated to rotate the turning arms 50, 50, whereby the sheet material transferring member 12 sucking and holding the sheet material 2 is moved from the sheet material delivery position B to the sheet material sticking position A. Further, the sheet material transferring member 12 after transferring the sheet material 2 to the screen of the picture tube 1 is moved from the sheet material sticking position A to the sheet material delivery position B. When the sheet material transferring member 12 is moved to the sheet material sticking position A, the sheet material transferring member 12 is supported so that its front end side (the forward side in the conveying direction of the picture tube 1) maybe slightly inclined downward, for example, by approximately 50° to 10°.

The sheet material supplying mechanism 16 comprises: a sheet material stocking portion 58, where sheet materials 2 are orderly piled up in the height direction, located on the base 24; a sheet material picking up mechanism 60 for picking up sheet materials 2 one by one from the sheet material stocking portion 58, a sheet material delivery mechanism 62 for sending the sheet material 2 which was picked up one by one by the sheet material picking up mechanism 60 toward the sheet material delivery position B; a pair of cleaning rollers 64 which are located between the sheet material sending mechanism 62 and the sheet material delivery position B and are rotatably supported; and a sheet material placing mechanism 66 for placing the sheet material 2 sent through the pair of cleaning rollers 64 on the sheet material transferring member 12. Detailed description of each mechanism is omitted herein. The sheet material picking up mechanism 60 comprises a sheet material sucking portion 70 having four suckers 68 which releasably suck the sheet material 2, and a drive 72 for reciprocating the sheet material sucking portion 70 in vertical direction and in horizontal direction (in vertical direction in FIG. 4). The sheet material placing mechanism 66 comprises a chuck 74 for freely grasping and releasing a back edge portion of the sheet material 2, and a cylinder 76 for reciprocating the chuck 74 in the back and forth direction (in horizontal direction in FIG. 4).

Sheet material positioning devices **78*a*, 78*b*, and 78*c* for positioning the sheet material 2 are located at the sheet material delivery position B where the sheet material 2 is delivered from the sheet material supplying mechanism 16 to the sheet material transferring member 12. These positioning devices 78*a*, 78*b*, and 78*c* position the sheet material 2 supplied from the sheet material supplying mechanism 16 on to the sheet material transferring member 12 so that a front end portion of the sheet material 2 may slightly protrude from a front end of the sheet material transferring member 12. After positioning, the intake blower connected to the sucking mouth 42 of the box member 32 of the sheet material transferring member 12 is operated, whereby the sucking belt 38 of the sheet material transferring member 12 sucks and holds the sheet material 2**.

A film stripping mechanism not shown is located at the sheet material delivery position B to strip a released film stuck on one face with an adhesive of the sheet material 2 from the sheet material 2 supplied from the sheet material supplying mechanism 16 and sucked and held by the sheet material transferring member 12. This film stripping mechanism strips the released film from the one face of the sheet material 2, whereby an adsorbent layer is exposed on the face, which is not sucked by the sucking belt 38, of the sheet material 2 held by the sheet material transferring member 12.

The sheet material pressing mechanism 18 is located on a forward side in the conveying direction of the picture tube 1 from the sheet material transferring member 12 moved to the sheet material sticking position A. The sheet material pressing mechanism 18 comprises: a pressure roller 80 which is located near the sheet material transferring member 12 and crosses the conveying direction of the picture tube 1 at a right angle; a pair of left and right bearings 82, 82 for rotatably supporting the pressure roller 80; a pair of left and right cylinders 84, 84 for reciprocating the pressure roller 80 in the back and forth direction (in the conveying direction of the picture tube 1) with the pair of bearings 82, 82; a pair of left and right elevating plates 86, 86 on which the cylinders 84, 84, bearings 82, 82, and pressure roller 80 are mounted; a pair of vertical supporting bars 88, 88 to upper end portions of which the elevating plates 86, 86 are respectively fixed; a pair of left and right cylindrical guides 92, 92 fixed to the base 24 and to a fixing frame 90 are slidably engaged with the vertical supporting bars 88, 88 respectively; a connecting frame 94 for connecting lower end portions of the vertical supporting bars 88, 88; and an elevation drive cylinder 96 fixed to the fixing frame 90 with a piston rod thereof connected to the connecting frame 94. An outer circumferential face of a middle portion of the pressure roller 80 is coated with a rubber material 98, and the portion coated with the rubber material 98 comes in contact with the sheet material 2 to be stuck on the screen of the picture tube 1.

When operating the elevation drive cylinder 96, the pressure roller 80 moves up and down, whereby the pressure roller 80 presses a part of the sheet material 2 pulled out from the sheet material transferring member 12 on the screen of the picture tube 1, and the pressure roller 80 leaves upward from the screen of the picture tube 1. When operating the cylinders 84, 84 mounted on the elevating plates 86, 86, the pressure roller 80 moves back and forth along with the bearings 82, 82, whereby the pressure roller 80 comes close to the sheet material transferring member 12, and the pressure roller 80 leaves and retires from the sheet material transferring member 12.

Described below is an operation of sticking the sheet material 2 on the flat screen of the picture tube 1 using the sheet material sticking apparatus of the foregoing construction.

First, as indicated by the solid line in FIG. 3 or shown in FIG. 4, the sheet material transferring member 12 moves to and stops at the sheet material delivery position B. At this sheet material delivery position B, one sheet material 2 is supplied from the sheet material supplying mechanism 16 onto the sheet material transferring member 12, and the sheet material 2 is positioned by the positioning apparatuses 78*a*, 78*b*, and 78*c* as described above. Then, the intake blower connected to the sucking mouth 42 of the box member 32 of the sheet material transferring member 12 is operated, and the sheet material 2 is sucked and held on the sucking belt 38 of the sheet material transferring member 12. When the sheet material 2 is held by the sheet material transferring member 12, the film stripping mechanism not shown strips a released film from one face of the sheet material 2 held by the sheet material transferring member 12.

Subsequently, the sheet material transferring member 12 holding the sheet material 2 with its sucked face exposed is moved from the sheet material delivery position B to the sheet material sticking position A by the transferring member supporting and moving mechanism 14. As indicated by the two-dot chain line in FIG. 3, when the sheet material transferring member 12 moves to and stops at the sheet material sticking position A, the cylinder 84 is operated to horizontally move the pressure roller 80 supported by the pair of bearings 82, 82 toward the sheet material transferring member 12. The pressure roller 80 stops at a position close to a forward side of the sheet material transferring member 12 as shown by the two-dot chain line in FIG. 3. In the meantime, the work supporting and conveying mechanism 10 conveys the picture tube 1 held by the movable stage 20 to the sheet material sticking position A. At the sheet material sticking position A, the screen of the picture tube 1 faces the sheet material 2 sucked and held on the sucking belt 38 of the sheet material transferring member 12.

Then, the elevation drive cylinder 96 of the sheet material pressing mechanism 18 is operated to move the pressure roller 80 downward. The pressure roller 80 presses the front edge portion of the sheet material 2 protruding forward from the sheet material transferring member 12 on the front edge portion of the screen of the picture tube 1. The front edge portion of the sheet material 2 is stuck to the front edge portion of the screen of the picture tube 1 with the adhesive. In this condition, the work supporting and conveying mechanism 10 horizontally moves the picture tube 1 held by the movable stage 20 forward, whereby the sheet material 2 held by the sheet material transferring member 12 is pulled by the adhered portion between the screen of the picture tube 1 and the sheet material. At this time, the pressure roller 80 rotates due to friction force generated between the surface of the sheet material 2 and the pressure roller 80. The sheet material 2 is gradually stripped from the sucking belt 38 of the sheet material transferring member 12, and the stripped portion of the sheet material 2 is gradually pressed on the screen of the picture tube 1 by the pressure roller 80. Thus, the sheet material 2 is gradually stuck onto the screen of the picture tube 1 with the adhesive.

In the process of pulling or drawing the sheet material 2 out from the sheet material transferring member 12 in the mentioned manner, the sucking belt 38 is moved round synchronously with the moving speed of the picture tube 1, i.e., moving speed of the sheet material 2, by the driving roller 34 driven and rotated by the drive motor 40. Therefore, the sucking belt 38 does not slip between the sheet material 2 and the sucking belt 38, and the surface of the sheet material 2 is prevented from being scratched. When the sucking belt 38 moves round according to the sheet material 2 pulled out from the sheet material transferring member 12, a part of the sucking belt 38 successively exposed on the open face of the box member 32 does not have any through hole 48 in the region of the sucking belt 38 where the sheet material is not stuck. Therefore, the open face of the box member 32 is blocked at all times by a part of the sheet material 2 and the portion without through hole of the sucking belt 38. Even when the sucking belt 38 moves round as the sheet material 2 is pulled out from the sheet material transferring member 12, the sucking force acting on the sheet material 2 is not reduced. As a result, the sheet material 2 is securely held by the sheet material transferring member 12 until the whole sheet material 2 has been stripped from the sucking belt 38.

When the whole sheet material 2 is pulled out from the sheet material transferring member 12 and transferred to the screen of the picture tube 1, thereby the sheet material 2 being completely stuck on the screen of the picture tube 1, the elevation drive cylinder 96 of the sheet material pressing mechanism 18 is operated to move the pressure roller 80 upward. After that, the cylinder 84 is operated to horizontally move the pressure roller 80 away from the sheet material transferring member 12, and the pressure roller 80 returns to the position indicated by the solid line in FIG. 3. Then, the sheet material transferring member 12 is moved from the sheet material sticking position A to the sheet material delivery position B by the transferring member supporting and moving mechanism 14. The sheet material transferring member 12 receives another sheet material 2 supplied from the sheet material supplying mechanism 16, and the foregoing operation is repeated.

In the embodiment of above construction, the sucking belt 38 in the sheet material transferring member 12 is an endless belt. This endless belt is put round a plurality of rollers 34, 36 located inside the box member 32 and is moved round. It is, however, also preferable to use a belt with ends as the sucking belt in which both end portions of the belt are wound round a pair of rollers respectively, and the belt is drawn from one roller and is wound on the other roller at the same time. In the foregoing embodiment, the large number of through holes 48 of the sucking belt 38 are formed only in the region of the length corresponding to the open face of the box member 32. It is, however, also preferable to form through holes on the whole face of the sucking belt on condition that the sheet material is held by the sheet material transferring member until the whole sheet material is stripped from the sucking belt. This construction is preferable even when the sucking belt 38 moves as the sheet material is pulled out from the sheet material transferring member and the sucking force acting on the sheet material is reduced in relation to the sucking force by the intake blower. Configuration and number of the through holes formed on the sucking belt 38 are not particularly defined. In the construction of the foregoing embodiment, the drive motor 40 drives and rotates the driving roller 34 to forcibly move the sucking belt 38 synchronously with the moving speed of the picture tube 1. It is however, also preferable that all the rollers on and round which the sucking belt is put are free rollers. In this construction, when the sheet material 2 is pulled by the adhered portion between the screen of the picture tube 1 and the sheet material 2 and is pulled out from the sheet material transferring member 12 as the picture tube 1 moves, the sucking belt 38 moves en bloc as the sheet material 2 moves due to the suction force and friction force of the sheet material 2 and the sucking belt 38.

Note that the invention is characterized in the construction of the sheet material transferring member. Therefore, the constructions of the picture tube supporting and conveying mechanism 10, the transferring member supporting and moving mechanism 14, the sheet material supplying mechanism 16, the sheet material pressing mechanism 18, and so on are not limited to those in the foregoing embodiment as a matter of course. For example, the sheet material transferring member is turned over when it is moved between the sheet material delivery position and the sheet material sticking position in the foregoing embodiment, however, it is also preferable to horizontally move the sheet material transferring member instead of turning it over.

The foregoing embodiment has been described taking a case of sticking a sheet material on a flat screen of a picture tube for television. However, the invention is also applicable to a further case in which a sheet material with an adhesive on one face is stuck to a work other than the picture tube.

What is claimed is:

1. An apparatus for sticking a sheet material comprising:

work supporting and conveying means for supporting and conveying a work in one direction;

a sheet material transferring member shaped into a box member and having a sheet material holding face for sucking and holding a sheet material to be stuck on a stuck face of the work;

suction means for sucking air inside of the box member of the sheet material transferring member so that the sheet material is stuck onto said sheet material holding face;

transferring member supporting and moving means for supporting and moving a transferring member, which supports said sheet material transferring member and reciprocates the sheet material transferring member between a sheet material sticking position, where the stuck face of the work conveyed by said supporting and conveying means faces the sheet material sucked and held on said sheet material holding face, and a sheet material delivery position where sheet materials are delivered one by one to the sheet material holding face;

sheet material supply means for supplying sheet material, which delivers sheet materials one by one to the sheet material holding face of said sheet material transferring member at said sheet material delivery position; and a pressure roller which is located on a forward side from said sheet material transferring member in the conveying direction of the work at said sheet material sticking position in such a manner as to come near the sheet material transferring member and cross the conveying direction of the work at a right angle, and turns on an axis while pressing a part of the sheet material on the stuck face of the work;

in which the work is conveyed by said work supporting and conveying means with said pressure roller pressing the sheet material, to one face of which an adhesive is applied, on the stuck face of the work, whereby the sheet material is gradually transferred from the sheet material holding face of said sheet material transferring member to the stuck face of the work, and the sheet material is stuck on the stuck face of the work with the adhesive;

wherein the improvement comprises: said box member having one face which is open and a sucking mouth connected to said suction means; and a sucking belt which is arranged to block the whole open face of said box member, has a plurality of through holes for sucking the sheet material, and is supported in such a manner as to move along the conveying direction of the work in said box member.

2. The apparatus for sticking a sheet material according to claim 1, wherein the sucking belt is an endless belt which is put on and moved round a plurality of rollers, said plural rollers being arranged to cross the conveying direction of the work at a right angle in said box member and are rotatably supported.

3. The apparatus for sticking a sheet material according to claim 1, wherein said through holes of said sucking belt are formed only in a region of a length corresponding to the open face of said box member, and the region functions as a sheet material sucking face.

4. The apparatus for sticking a sheet material according to claim 1, wherein the apparatus is provided with belt drive means for driving a belt which moves said sucking belt synchronously with a moving speed of the work conveyed by said work supporting and conveying means.

5. The apparatus for sticking a sheet material according to claim 1, wherein the work is a picture tube for television, and the sheet material is stuck on a flat screen of the picture tube.

* * * * *